US007275652B2

(12) United States Patent
Morris et al.

(10) Patent No.: US 7,275,652 B2
(45) Date of Patent: Oct. 2, 2007

(54) CUP LID APPARATUS

(76) Inventors: Jeffrey M. Morris, 410 Castlewood La., Buffalo Grove, IL (US) 60089; David C. Wheeler, 240 Tower Rd., Barrington, IL (US) 60010

( * ) Notice: Subject to any disclaimer, the term of this patent is extended or adjusted under 35 U.S.C. 154(b) by 248 days.

(21) Appl. No.: 10/680,545

(22) Filed: Oct. 7, 2003

(65) Prior Publication Data

US 2005/0072787 A1 Apr. 7, 2005

(51) Int. Cl.
*A47G 19/22* (2006.01)

(52) U.S. Cl. ..... 220/212; 220/719; 220/780; 220/713; 220/254.5; 229/404; 229/906.1

(58) Field of Classification Search ..... 220/703, 220/710, 711, 712, 713, 714, 717, 719, 254.7, 220/212, 254.3; 222/189.07; 229/404, 906.1
See application file for complete search history.

(56) References Cited

U.S. PATENT DOCUMENTS 442,698 A * 12/1890 Yates ..... 604/57
776,917 A * 12/1904 Kingsbury ..... 222/189.07
816,858 A * 4/1906 Ham ..... 222/189.07
874,437 A * 12/1907 Puckett ..... 210/245
962,641 A * 6/1910 Kaufmann ..... 220/703
1,146,573 A * 7/1915 Jacobs ..... 266/230
1,269,902 A * 6/1918 Butler ..... 210/469
1,339,008 A * 5/1920 Strong ..... 222/189.07
2,598,987 A * 6/1952 Franzen ..... 215/228
2,599,919 A * 6/1952 Hucknall ..... 220/710
2,748,946 A * 6/1956 Smith ..... 210/244
2,840,239 A * 6/1958 Wethammer ..... 210/467
2,978,141 A * 4/1961 Jacobs ..... 220/212
3,400,855 A * 9/1968 Alexander ..... 220/719
3,917,533 A * 11/1975 Macaluso, Jr. ..... 210/469
4,090,660 A * 5/1978 Schram et al. ..... 229/404

(Continued)

*Primary Examiner*—Nathan J. Newhouse
*Assistant Examiner*—James Smalley
(74) *Attorney, Agent, or Firm*—Jeffrey M. Morris

(57) ABSTRACT

A cup lid for use with a drinking cup containing a liquid, the drinking cup having a base and a sidewall extending upwardly from the base, the sidewall including an inner surface, a top end, and a rim extending along the circumference of the top end. The cup lid comprises a first part lying in a first plane and having a top surface and a center axis, means on said first part for releasably mounting the first part to the top end of the cup to form a substantially liquid tight seal between the cup lid and the cup, a second part depending radially outwardly from the first part and lying in a second plane, the second part having means for movement relative to the first part, compartment means between the cup and the cup lid for bifurcating the liquid in the cup into one portion and a second portion, the one portion comprising means for facilitating the flow of liquid into the compartment means and the second portion for facilitating the flow of liquid out of the compartment means, the first part and the second part further comprise aperture means for permitting the liquid contained in said one portion to flow out of the compartment means and out of the drinking cup. The second part comprises baffle means for substantially shielding the liquid in the one portion from substantial interference with the liquid in the second portion during any lateral movement of the cup whereby any spillage of the liquid out of the cup is substantially minimized.

29 Claims, 9 Drawing Sheets

U.S. PATENT DOCUMENTS 4,437,576 A * 3/1984 Barniak ..... 220/710
RE31,650 E * 8/1984 Serritella ..... 229/404
4,619,372 A * 10/1986 McFarland ..... 220/713
5,197,624 A 3/1993 Dodaro
5,348,181 A * 9/1994 Smith et al. ..... 220/254.3
5,398,843 A 3/1995 Warden et al.
5,485,938 A 1/1996 Boersma
5,509,568 A 4/1996 Warden et al.
5,613,619 A 3/1997 Van Melle
5,692,616 A 12/1997 Baker
5,695,084 A * 12/1997 Chmela et al. ..... 220/212
5,699,927 A 12/1997 Lane et al.
6,070,755 A * 6/2000 Evans et al. ..... 220/793
6,076,450 A 6/2000 DiGiorgio, Jr.
6,089,397 A 7/2000 Van Melle
6,142,335 A * 11/2000 Query, Jr. ..... 220/707
6,260,727 B1 7/2001 Duron
6,311,863 B1 * 11/2001 Fleming ..... 220/713
6,375,033 B1 * 4/2002 Fleming ..... 220/713
6,394,302 B1 * 5/2002 Query, Jr. ..... 220/707
D463,208 S 9/2002 Copeland
6,595,394 B1 * 7/2003 Savala ..... 222/189.07
6,783,018 B1 * 8/2004 Rondeau ..... 220/254.3

* cited by examiner

FIG.1
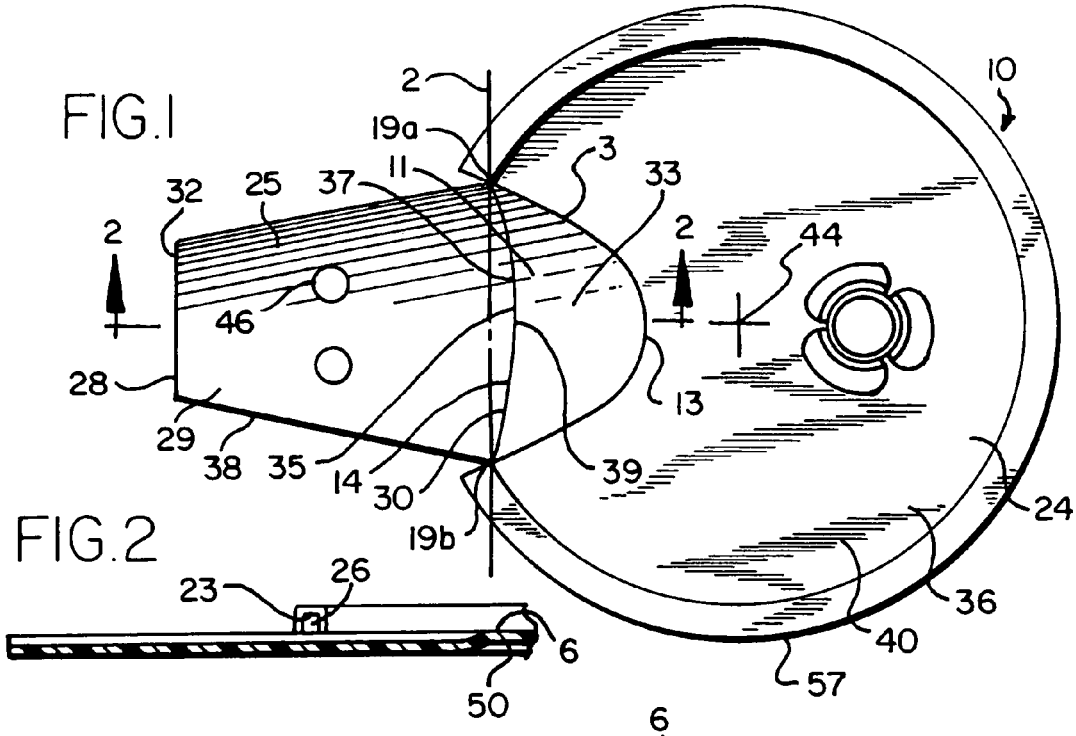
FIG.2
FIG.3
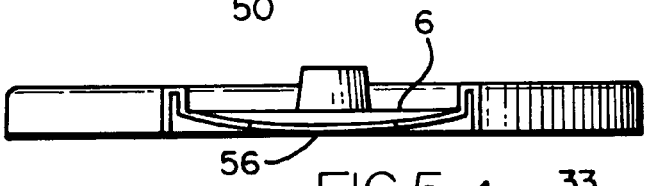
FIG.4
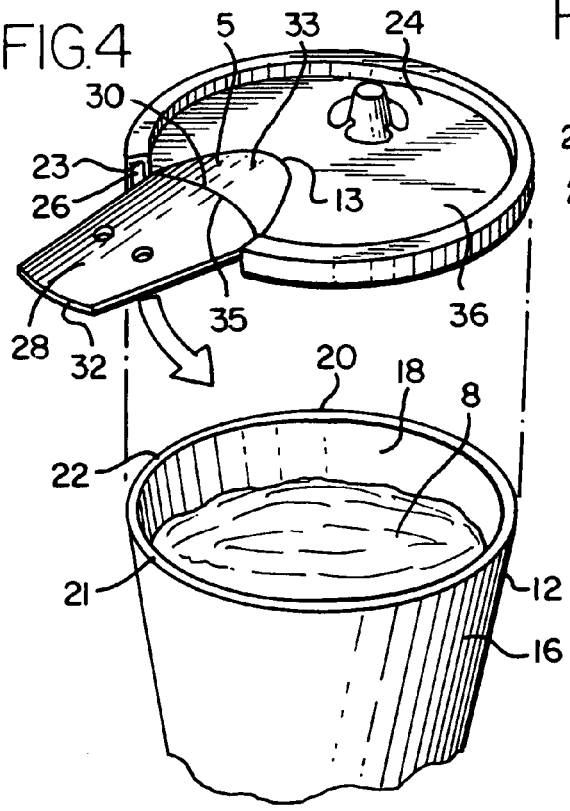
FIG.5
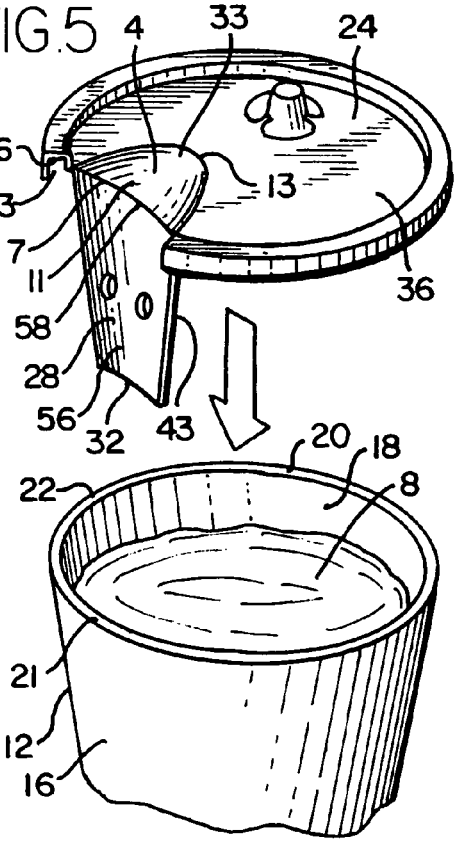

| | TEST NO. 1 | |
|---|---|---|
| TIME Minutes | CONVENTIONAL CUP LID Degrees Fahrenheit | PRESENT INVENTION CUP LID Degrees Fahrenheit |
| 0 | 150 | 150 |
| 2 | 148.3 | 148.5 |
| 4 | 146.2 | 147 |
| 6 | 144.3 | 145.3 |
| 8 | 142.9 | 143.9 |
| 10 | 140.9 | 142.3 |
| 12 | 139.1 | 141 |
| 14 | 137.7 | 139.5 |
| 16 | 136.2 | 138.4 |
| 18 | 134.8 | 137 |
| 20 | 133.5 | 135.7 |

| | TEST NO. 2 | |
|---|---|---|
| TIME Minutes | CONVENTIONAL CUP LID Degrees Fahrenheit | PRESENT INVENTION CUP LID Degrees Fahrenheit |
| 0 | 150 | 150 |
| 2 | 148.4 | 148.5 |
| 4 | 146.5 | 147 |
| 6 | 144.2 | 145.5 |
| 8 | 142.4 | 144.1 |
| 10 | 141.4 | 142.4 |
| 12 | 140 | 141.1 |
| 14 | 138.3 | 139.7 |
| 16 | 136.7 | 138.4 |
| 18 | 135.2 | 137.1 |
| 20 | 134 | 136 |

| | TEST NO. 3 | |
|---|---|---|
| TIME Minutes | CONVENTIONAL CUP LID Degrees Fahrenheit | PRESENT INVENTION CUP LID Degrees Fahrenheit |
| 0 | 150 | 150 |
| 2 | 148.2 | 148.6 |
| 4 | 146.1 | 147.1 |
| 6 | 144.3 | 145.7 |
| 8 | 142.7 | 144.2 |
| 10 | 141 | 142.7 |
| 12 | 139.3 | 141.2 |
| 14 | 137.8 | 139.7 |
| 16 | 136.4 | 138.4 |
| 18 | 134.7 | 137.1 |
| 20 | 133.4 | 135.9 |

| | 0 | 2 | 4 | 6 | 8 | 10 | 12 | 14 | 16 | 18 | 20 |
|---|---|---|---|---|---|---|---|---|---|---|---|
| 1A | 150 | 148.3 | 146.2 | 144.3 | 142.9 | 140.9 | 139.1 | 137.7 | 136.2 | 134.8 | 133.5 |
| 2A | 150 | 148.4 | 146.5 | 144.2 | 142.4 | 141.4 | 140 | 138.3 | 136.7 | 135.2 | 134 |
| 3A | 150 | 148.2 | 146.1 | 144.3 | 142.7 | 141 | 139.3 | 137.8 | 136.4 | 134.7 | 133.4 |
| | | | | | | | | | | | |
| | | | | | | | | | | | |
| | | | | | | | | | | | |
| 1B | 150 | 148.5 | 147 | 145.3 | 143.9 | 142.3 | 141 | 139.5 | 138.4 | 137 | 135.7 |
| 2B | 150 | 148.5 | 147 | 145.5 | 144.1 | 142.4 | 141.1 | 139.7 | 138.4 | 137.1 | 136 |
| 3B | 150 | 148.6 | 147.1 | 145.7 | 144.2 | 142.7 | 141.2 | 139.7 | 138.4 | 137.1 | 135.9 |

CUP LID APPARATUS

BACKGROUND OF THE INVENTION

The present invention relates to a plastic lid for a drinking cup. In particular, the invention relates to a lid having a flexible flange which depends downwardly into the cup and rests contiguously against the cup's inner sidewall surface to form a channel and two apertures through which the contents of the cup may be emptied.

Drinking cups are a ubiquitous product in the beverage industry. It is common to use drinking cups made out of Styrofoam and the like especially for take-out restaurants and convenience stores. It is common practice to use a cup lid with the cups especially when the drinks are carried to present spillage. However, conventional cup lid designs are not consumer friendly especially when used to drink hot liquids, such as coffee or tea and the like. There are many prior art drinking cup lids which come in various permutations. One type of prior art lid acts as a solid cover which is attached to the rim of the cup to prevent the liquid from spilling or splashing out of cup during movement. An example of such a cup lid may be found in Mack U.S. Pat. No. Des. 339,027. The contents of a cup using this type of lid cannot be easily enjoyed, because the entire lid must be removed to drink the contents which is at best cumbersome and at worst, dangerous, especially when the liquid contents of the cup is hot, such as coffee and the like.

Another type of prior art cup lid has a perforated section which forms a drinking aperture when bent backwards and/or removed from the lid. Examples of this type of cup lid may be found in Dodaro U.S. Pat. No. 5,197,624; Durdon U.S. Pat. No. 6,260,727B; Van Melle U.S. Pat. No. 5,613,619; and Lane U.S. Pat. No. 5,699,927. A problem with these types of lids is that the section of the lid, which is folded, is very cumbersome to remove thereby increasing the probability that the contents of the cup will be spilled during the removal process. Also, once the section is removed, the possibility of spillage increases when the cup is suddenly jarred, moved or tilted because the aperture is large to accommodate drinking. Spillage most commonly occurs when the cup is placed in a car's cup holder and the car accelerates or decelerates suddenly.

Still another type of prior art lid has a pre-formed drinking aperture which is intended to minimize spillage. Examples of this type of cup lid are found in Warren U.S. Pat. No. 5,398,843; Van Melle U.S. Pat. No. 5,253,781; and Freek U.S. Pat. No. Des. 379,928. The apertures disclosed in the aforementioned prior art patents are very small so as to minimize spillage. This design feature, however, while minimizing spillage, has the disadvantage of hindering one's ability to comfortably drink the beverage since typically, only a small amount of liquid can be drained from the cup with each sip.

Another disadvantage of the prior art is that the cup lids provide no means for keeping the contents of the cup hot for an extended period of time. There is virtually no temperature gradient of the liquid when the prior art lids are used with a hot liquid. All of the liquid in the cup will cool at the same temperature at the same rate of time.

Consequently, it is apparent that there is a need for a cup lid which not only permits one to drink the contents comfortably and helps to prevent spillage but also is able to keep hot liquids hotter over a longer period of time.

BRIEF SUMMARY OF THE INVENTION

In accordance with the present invention, these and other problems are overcome by providing a cup lid for use with a cup and having a top edge. The cup lid has a first part lying in a first plane, a top surface, a center axis perpendicular to the first plane and an edge having a perimeter. Means are on the first part for releasably mounting the first part to the top edge of the cup to provide a substantially liquid tight seal between the cup and the first part. A second part extends outwardly from the first part and lies in a second plane and has a longitudinal axis. Means are on the first part and on the second part for movement of the second part between a first position wherein the second plane is co-planar with the first plane, a second position which is spaced apart and away from the first position wherein the second plane is not co-planar with the first plane, and a third position spaced between the first position and the second position wherein the second plane is not co-planar with the first plane. The first part and the second part further comprise biasing means for moving the second part away from the second position and towards the third position. Means are provided on the first part and on the second part for forming an opening which is contiguous to the perimeter and is created when the second part is moved from its first position to its second or third positions. The first part comprises a first section and a second section wherein the second section is substantially flat and lies in the first plane, a concave cross-sectional area relative to the first plane when the second part is in the first position and the second part further comprises a concave cross-sectional area relative to the first plane when the second part is in the first position. The second part further comprises a concave cross-sectional area relative to the first plane when the second part is in the second position and the first section of the first part comprises a convex cross-sectional area relative to the first plane when the second part is moved from its first position. The second part further comprises a longitudinal flange which has a proximal end and a distal end. The flange is tapered away from the proximal end and to the distal end and further comprises at least one opening. The proximal end of the second part is integral with and moveable relative to the first part and the distal end is spaced apart and away from the proximal end. The first section comprises the shape of a parabola which has an apex and a base. The apex is spaced apart and away from the base which is located near to the proximal end of the second part and is further located between the base and the center axis. The base of the parabola comprises an arc which has an apex with an axis of rotation and the arc is concave relative to the distal end of the second part and convex relative to the center axis of the first part. The arc further comprises a crease on the first part and the crease comprises means for creating the biasing means on the first part and on the second part and for facilitating the movement of the second part relative to said first part. Means are provided on the arc apex for movement in an upward direction about the arc axis of rotation when the second part is moved from its first position towards its second position thereby creating biasing means in the first section to force the movement of the second part away from the second position and towards the third position. A third part is provided having a substantially flat surface, an outer edge and lies in a third plane. Means for mounting the third part to the first part for movement of the third part between a closed position wherein the outer edge is engaged with the top edge of the cup to provide a substantially liquid tight seal therewith when the second part is moved from its first position and an open position wherein the outer edge is disengaged from the top edge of the cup thereby exposing the opening which is created by the movement of the first part and the second part away from its first position. The third part and the first part further comprise means for removing the third part from said first part.

In accordance with the present invention, these and other problems are overcome by providing a cup lid for a drinking cup containing a liquid, the cup having a base and a sidewall extending upwardly from the base, the sidewall including an inner surface, a top end, and a rim extending along the circumference of the top end. The cup lid comprises a first part lying in a first plane and having a top surface and a center axis, means on the first part for releasably mounting the first part to the top end of the cup to form a substantially liquid tight seal between the cup lid and the cup, a second part depending radially outwardly from the first part and lying in a second plane, the second part having means for movement relative to said first part, compartment means formed by the second part and the inner sidewall surface and also between the cup and the cup lid for bifurcating a portion of the liquid in the cup into one portion and a second portion, the one portion comprising means for facilitating the flow of liquid into the compartment means and the second portion for facilitating the flow of liquid out of the compartment means, the first part and the second part further comprise first aperture means for permitting the liquid contained in the one portion to flow out of the compartment means and out of the drinking cup, the second part comprises baffle means for substantially shielding the liquid in the one portion from substantial wave interference with the liquid in the second portion during any lateral movement of the cup whereby any spillage of the liquid out of the cup is substantially minimized.

The cup lid further comprises means on the second part for movement from a first position wherein the second part is substantially co-planar to the first part, to a second position wherein the second part is non-coplanar with the first part; and, the one portion comprises a channel having a bottom end which is formed when the second part is in the second position for permitting the ingress of liquid from the second portion into the channel and an upper end on the channel which is formed when the second part is in the second position for permitting the egress of the liquid out of said channel. The channel further comprises a second aperture at the bottom end when the second part is at the second position to permit the liquid to ingress into the channel, a third aperture at the upper end when the second part is at the second position to permit the liquid to egress out of the channel, and the second part comprises baffle means for isolating the liquid contained in the channel from substantial interference with the liquid which is contained in the second portion during any lateral movement of the cup whereby any potential spillage of the liquid out of the cup is substantially reduced.

The first part and the second part further comprise biasing means for urging at least a portion of the second part to move adjacent said inner sidewall surface when the cup lid is releasably mounted to the top end of the cup. The cup lid further comprises at least one aperture on the second part for facilitating the flow of the liquid contained in the second portion into the compartment means. The first part comprising a first section and a second section, the second section having a substantially flat cross-sectional area and the first section comprises a substantially concave cross-sectional area relative to the second section when the second part is in the first position and the second part comprises a substantially concave cross-sectional area relative to the second section when the second part is in the first position. The second part comprises a concave cross-sectional area relative to the second section of the first part when the second part is in the second position and the first section of the first part comprises a convex cross-sectional area relative to the second section of the first part when the second part is in the second position. The second part comprises a longitudinal flange which is tapered in a direction away from said first part.

The first part further comprises a slotted peripheral edge extending along a portion of the perimeter of the first part and the slotted edge comprises means for releasably mounting the cup lid to the rim for forming a substantially liquid tight seal between the cup lid and the cup. The second part comprises a proximal end which is integral with and hingedly attached to the first part and a distal end which is spaced apart and away from the proximal end. The first section comprises the shape of a parabola which comprises an apex and a base. The apex is spaced apart and away from the base is proximate to the proximal end of the second part and the apex is proximate to the center axis. The base comprises the shape of an arc and the arc comprises an apex and an axis of rotation wherein the arc is facing concave in the direction of the distal end of the second part and is facing convex in the direction of said center axis of the first part. The base of the arc further comprises a crease in the cup lid and the crease coincides with the length and direction of the arc. The apex of the arc rotates in an upward direction about the axis of rotation of the arc when the second part is moved from its first position to its second position thereby creating biasing means in the first part and in the second part for causing said second part to move substantially adjacent to the inner sidewall surface when the cup lid is releasably mounted to the cup.

The third aperture is located between the rim and the proximal end of the second part when the second part is at its second position. The second aperture is located between the inner sidewall surface and the distal end of the second part when the second part is at its second position. The cup lid further comprises a third part which is hingedly attached to said first part and means on the third part for movement between a closed position wherein the third part is releasably mounted to the cup and is positioned substantially over and above the aperture means to form a substantially liquid tight seal between the cup lid and the cup thereby preventing the substantial egress of liquid out of the cup and an open position wherein the third part is released from the cup thereby permitting the egress of liquid out of the cup through the first aperture means. The third part further comprises means for removing the third part from the first part.

In a third embodiment of the present invention an insert is provided which in combination with the cup lid forms a baffle to substantially minimize the spillage of liquid out of the cup. The insert comprises a flat circular first part and a second part which is attached to the first part and downwardly depends from the first part and which rests against the inner sidewall surface of the drinking cup when the insert is releasably mounted to the upper end of the cup. The cup lid is releasably mounted over the insert and onto the rim of the cup.

In a fourth embodiment of the present invention an insert is provided which in combination with the cup lid forms a baffle to substantially minimize the spillage of liquid out of the cup. The insert comprises a first part which fastens over the rim of the cup with a hook-like attachment means whereby the insert is prevented from substantial movement in the cup when the cup lid is mounted onto the rim of the cup.

It is an object of the present invention to provide a cup lid which is manufactured out of a think thermoplastic material to provide an inexpensive yet functional lid.

It is a further object of the present invention to provide a cup lid which is easy to releasably mount to the top of a drinking cup to provide a liquid tight seal.

It is another object of the present invention to provide a cup lid which forms a comfortable and functional drinking aperture when releasably mounted to the top of a drinking cup to provide a liquid tight seal.

It is still a further object of the present invention to provide a cup lid which forms two liquid filled compartments within the cup wherein each compartment contains a hot liquid and wherein the liquid contained within one compartment stays hotter for a longer period of time than the liquid which is in the other compartment.

It is still another further object of the present invention to provide a cup lid which forms two compartments within the cup wherein each compartment contains a liquid and wherein the liquid contained within the channel compartment does not easily spill out of the cup when the cup is at least moved laterally.

These and other objects and advantages of the present invention will be made apparent from the following detailed description of the preferred embodiments, with reference to the accompanying drawing. In the drawing, the same reference numbers are used to identify similar elements in the various embodiments.

BRIEF DESCRIPTION OF THE DRAWING

FIG. 1 is a top view of the preferred embodiment of the present invention;

FIG. 2 is an elevational cross-sectional view of the preferred embodiment of the present invention taken along line 2-2 of FIG. 1;

FIG. 3 is a front elevation view the preferred embodiment of the present invention;

FIG. 4 is an exploded perspective view of the preferred embodiment of the present invention and a partial perspective view of a liquid filled drinking cup;

FIG. 5 is an exploded perspective view of the preferred embodiment of the present invention and a partial view of a liquid filled drinking cup;

DETAILED DESCRIPTION OF THE INVENTION

Figure 6:
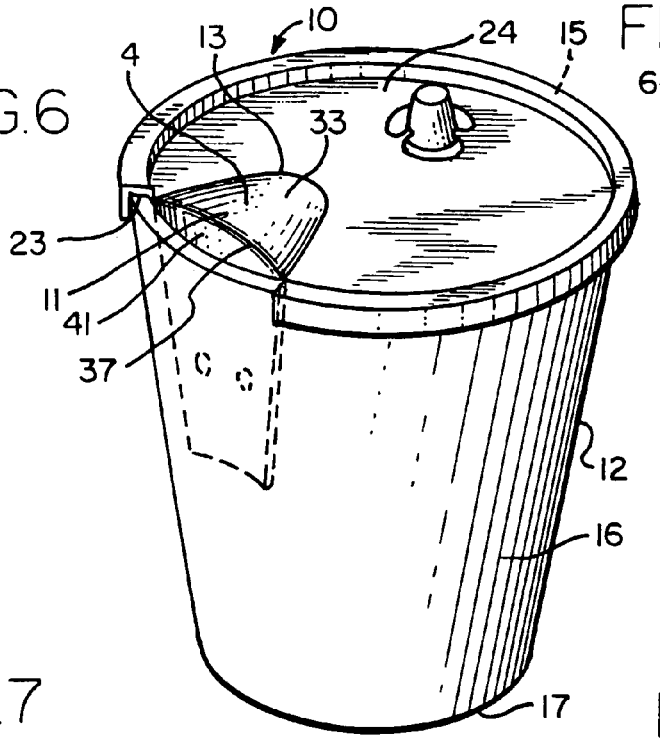
FIG. 6 is a perspective view of the preferred embodiment of the present invention.

A detailed description of the preferred embodiment and best mode for practicing the invention are described herein. While the present invention is described in greater detail relative to the enclosed drawings in which the preferred method of practicing the present invention are shown, it should be acknowledged that persons skilled in the relevant arts may modify certain aspects of the invention herein described while still arriving at the same positive conclusions with regards to this invention. Consequently, the following description is intended to be a general, instructive disclosure and is not intended to be restrictive upon the present invention.

Referring to FIGS. 1 to 10, there is shown cup lid 10 or "lid 10", which is the preferred embodiment of the present invention. Cup lid 10 is used with a drinking cup 12 containing a liquid 8 and which comprises a base 17, a sidewall 16 having an inner surface 18 which extends upwardly from the base 17, a top end 20 terminating at a rim 22 which extends along the circumference 21 of the top end 20 of cup 12.

Lid 10 comprises a first part 24 having a top surface 40 and a center axis 44. Top surface 40 is generally flat, circular in shape and lies in a first plane. Lid 10 is normally manufactured out of a very thin thermoplastic material. A sheet of the plastic material is heated over a vacuum mold, which softens the material and forms the lid. After the vacuum forming process, the thermoplastic material is removed from the mold and cools into a hardened state. During the forming process, a peripheral slotted edge 26 is also formed along the perimeter 57 of the lid 10, which provides means for releasably mounting the first part 24 to the rim 22 at the top end 20 of the cup 12 to provide a substantially liquid tight seal 15 between the lid 10 and the cup 12.

In the preferred embodiment of the present invention, there is provided a second part 28, which is formed out of the same thermoplastic material as the first part 24 and which is a part of and integral with the first part 24. The second part extends radially outwardly 25 from the first part 24 and lies within the same plane as the first part 24. See, FIG. 3.

Figure 7:
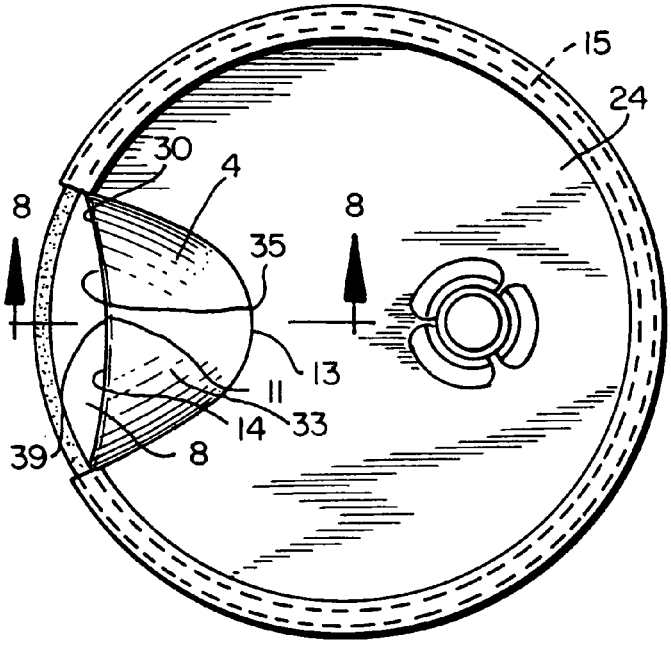
FIG. 7 is a top view of the preferred embodiment of the present invention and a liquid filled drinking cup.
Figure 8:
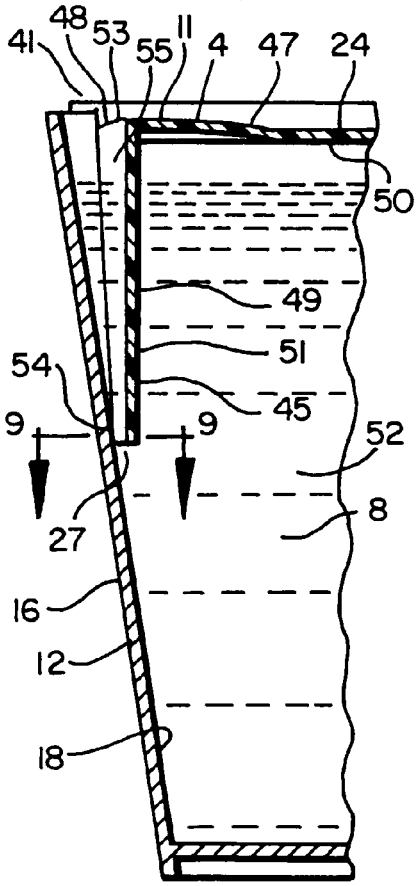
FIG. 8 is a partial cross sectional end elevational view of the preferred embodiment of the present invention and a liquid filled drinking cup taken along line 8-8 of FIG. 7.
Figure 9:
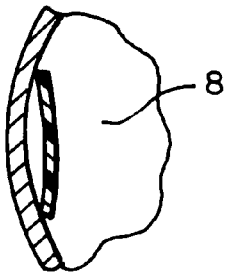
FIG. 9 is a partial cross sectional top view of the preferred embodiment of the present invention and a liquid filled drinking cup taken along line 9-9 of FIG. 8.

The second part 28 is formed out of the same thermoplastic material as the first part 24 and as previously described, is preferably integral with first part 24 thereby comprising one continuous unitary part. The second part 28 moves independently of the first part 24 from a first position 42 to a second position 43 which is non-coplanar with first part 24. When second part 28 is moved to its second position 43 and the slotted edge 26 of cup lid 10 is inserted and mounted onto the rim 22 at top end 20 of the cup 12, second part 28 forms a compartment 49 between the cup 12 and the second part 28 thereby bifurcating the cup 12 into two portions. One portion 51 comprises a channel 48 for facilitating the flow of the liquid 8 into the compartment 49 from the second portion 52 which comprising the remaining liquid 8 of cup 12 which is outside the one portion 51. As shown in FIG. 7, first part 24 and second part 28 form a first aperture 41 at the upper end 53 of the channel 48 which permits the liquid 8 to flow out of the compartment 49 when the cup 12 is emptied. The positioning of second part 28 in cup 12 when lid 10 is mounted to rim 22 transforms second part 28 into a baffle 45 which substantially shields the liquid 8 contained therein from the wave movement of the liquid 8 contained in the second portion 52 of the cup 12 during any lateral movement of the cup so that spillage of the liquid 8 out of the one portion 51 is kept to a minimum and is greatly reduced when compared to the ability of the standard or customary cup lids shown in the prior art. As previously discussed, second part 28 moves independently of first part 24 from a first position 42 where the second part 28 is substantially co-planar with the first part 24 to a second position 43 wherein the second part 28 is not coplanar with the first part 24. Referring to FIG. 8, when the second part 28 is at its second position 43, it forms a channel 48, which comprises a bottom end 27 to facilitate the flow of the liquid from the second portion 52 of the cup 12 into the channel 48 through second aperture 54. Channel 48 also comprises an upper end 53, which permits the egress of the liquid 8 out of the channel 48 through third aperture 55.

When second part 28 is in its second position 43, internal stresses formed in the first part 24 and the second part 28 hereinafter more fully described cause the second part 28 to spring or bias forward towards the inner sidewall surface 18 of the cup 12 thereby coming to rest adjacent the inner sidewall surface 18 once the cup lid 10 is mounted to the top end 20 of the cup by pushing together the slotted peripheral edge 26 along the perimeter 57 of the first part 24 of the cup lid 10. This slotted edge 26 provides means for forming a substantially liquid tight seal 15 between the rim 22 of the cup 12 and the cup lid 10. The second part 28 comprises a longitudinal flange 29 which is tapered 38 in a direction away from the first part 24. Flange 29 comprises a proximal end 30 which is integral with and hingedly co-joined or attached to the first part 24 at junction 34. Distal end 32 on second part 28 (or flange 29) is spaced apart and away from the proximal end 30. At the junction 34 of second part 28 and first part 24 a permanent crease 37 is formed in the plastic in the shape, length and direction of an arc 35 which bifurcates lid 10 into first part 24 and second part 28. Crease 37 terminates at two ends 19*a* and 19*b* so that second part 28 may move independently of first part 24 a plurality of times without tearing the thermoplastic material in the process. In the preferred embodiment of the present invention, second part 28 comprises at least one aperture or hole 46 which may be any shape since the purpose of this aperture 46 is to facilitate the flow of liquid 8 from the second portion 52 of cup 12 into the channel 48 during drinking or pouring of the liquid 8. The aperture 46 in second part 28 is preferably located in the bottom half of the flange 29 which is closer to the distal end 32, since it has been determined that an aperture 46 located in the top half of flange 29 may reduce the effective flow of liquid 8 into the channel 48 when the contents of the cup are low.

As previously discussed, first part 24 and second part 28 are manufactured so that they lie in the same plane. See FIG. 3. The first part 24 of lid 10 further comprises a first section 33 and a second section 36. First section 33 is formed out of the thermoplastic material of first part 24 and comprises a parabolic shape 35 comprising an apex 13 which is spaced apart and away from a base 14 which is proximate to the proximal end 30 of the second part 28. The apex 13 is proximate to the center axis 44 of the first part 24. Base 14 is identical to and concurrent with arc 35 wherein the apex 39 of arc 35 faces in the direction of the center axis 44 of first part 24. Arc 35 also comprises an axis of rotation 2 which bisects ends 19*a* and 19*b* of arc 35. The rotation of apex 39 in an upward direction around the axis of rotation 2 of arc 35 during the initial movement of second part 28 before it comes to rest at its second position 43 creates stress forces in first section 33 which are opposite in vector force and direction to the vector direction and force of second part 28 before it is released in the cup 12. The stress forces thereby created in first section 33 and second part 28 during this process deform first section 33 into a slightly convex cross sectional area shape 4 which seek to return to its original concave cross section shape whereby moving second part 28 to be against inner sidewall 18 of cup 12 when the cup lid 10 is mounted on cup 12. Prior to movement of second part 28, arc 35 faces concave in the direction of the distal end 32 of the second part 28 and conversely, faces convex in the direction of the center axis 44 of the first part 24. First section 33 comprises a concave cross sectional area 5 relative to the flat top surface 40 of first part 24 and second section 36 when the second part 28 is in its first position 42 which is co-planar with first part 24. See FIG. 3. In the first position 42, the second part 28 also comprises a concave cross-sectional area 56 relative to the flat top surface 40 of first part 24 when the second part 28 is in its first position 42. Crease 37 also performs another function which is to prevent the plastic material from easily tearing during the movement of second part 28.

The method for mounting the cup lid 10 to cup 12 is very simple and requires the steps of bending the second part 28 (or flange 29) in a downward direction towards the bottom surface 50 of cup lid 10 until first part 24 and second part 28 are non-coplanar with each other. Second part 28 need only be bent slightly more than 90 degrees from the horizontal plane of first part 24 before bending is terminated in order for second part 28 to fit into cup 12. After bending is completed second part 28 is inserted into cup 12 and lid 10 is then mounted onto rim 22 by pushing slotted peripheral edge 26 onto rim 22 of cup 12 around the circumference of lid 10. The mounted lid 10 is shown in FIG. 6. The result of this method is to provide a cup lid 10 and cup 12 assembly whereby there is an ample opening 41 in the cup lid 10 to drink or pour the contents out without the common annoyance of using a cup lid and cup this is prone to spillages when the cup is moved even lightly in a lateral direction during use.

After mounting, as previously stated, second part 28 comes to rest against the inner sidewall surface 18 of cup 12 thereby forming a channel 48 or compartment 49 which comprises a bottom end 27 and an upper end 53. Bottom end 27 forms a second aperture 54 and upper end 53 forms a third aperture 55. The liquid 8 in the cup 12 substantially flows into second aperture 54, through channel 48 and out of third aperture 55 when the cup 12 is either tilted or inverted during use.

As seen in FIG. 8. and as previously discussed, second part 28 rests contiguous to the inner sidewall 18 of cup 12 due to the forces generated by the concave/convex cross sectional shape changes of first section 33. In its second and stationary position 43, second part 28 acts as a baffle 45 against the interference of wave movement of liquid 8 in compartment 58 and channel 48, thereby creating a relatively calm environment for the liquid 8 which will be substantially unaffected by the wave motion of the liquid 8 which is in second portion 52. The advantage and novel feature of the present invention is that moderate to fast lateral movement of the cup 12, does not cause a substantial quantity of the liquid 8 to spill out of the cup 12. This anti-spillage feature is a welcomed feature to all drinkers since it is a common and annoying problem to any drinker to have the contents of the cup to frequently spill out of the cup during normal and non-vigorous pursuits, such as walking and driving a car. Indeed, the advantages and novel features of the present invention also provide the consumer with an added measure of safety by helping to reduce the incidence of accidental burning caused by the spillage of hot liquids contained in the cup.

It should be noted that the preferred embodiment of the present invention offers no significant disadvantage over cup lids presently used in the beverage industry. For example, the added cost of manufacture of the lid is relatively insignificant since the only change in design is the addition of the second part 28 to the first part 24. The cost of this additional feature is estimated to be de minimus at most. The small added cost is most certainly offset by the convenience offered by the present invention. These and other advantages of the present invention most certain can translate into increased sales of beverages and other food and non-food items for the business establishment which uses the present invention. The cup lid 10 may be also is easily stored or stacked one on top of the other, in the same racks currently used to store cup lids as presently done with conventional lids. Thus packaging for shipment from the manufacturer to customer will not be adversely affected, inconvenient or expensive to all parties in the supply lines.

Figures 20A, 20B:
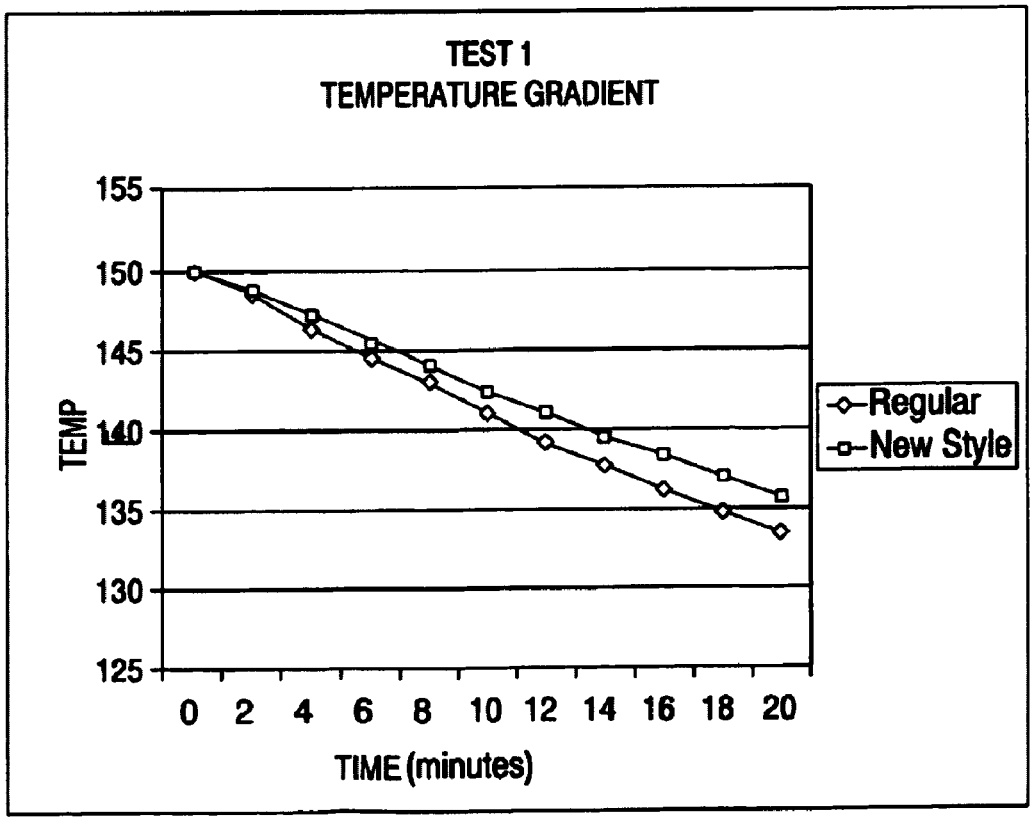
FIG. 20A discloses the test data for Test No. 1.
FIG. 20B discloses the Temperature Gradient graph for Test 1.
Figures 21A, 21B:
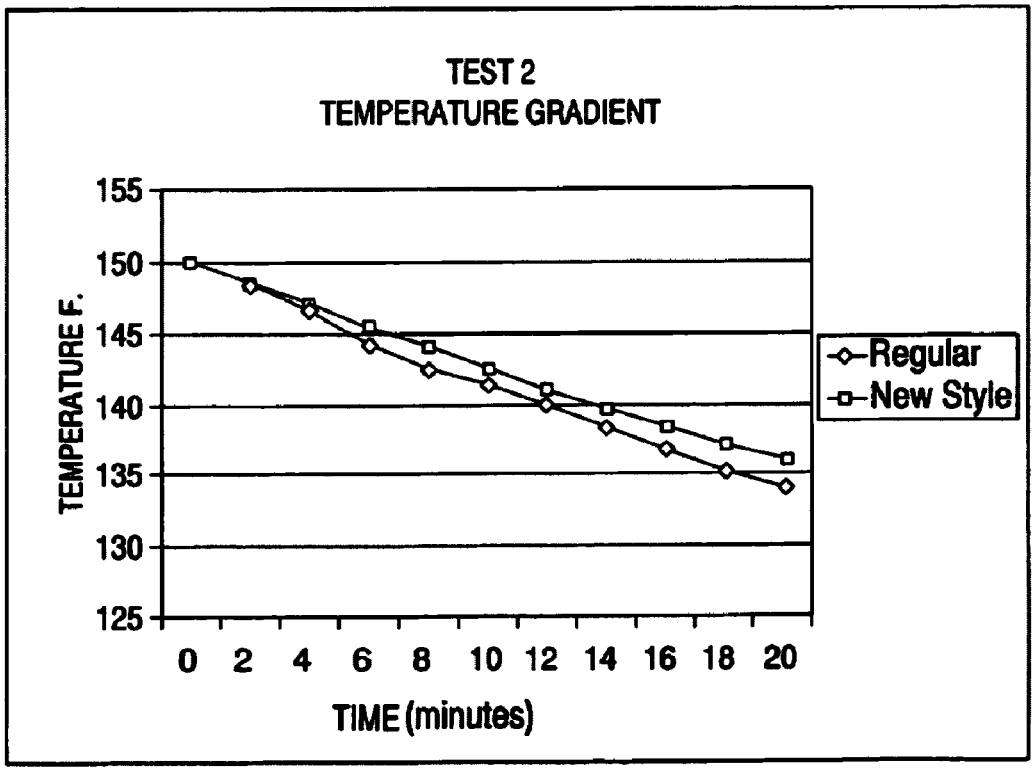
FIG. 21A discloses the test data for Test No. 2.
FIG. 21B discloses the Temperature Gradient graph for Test 2.
Figures 22A, 22B:
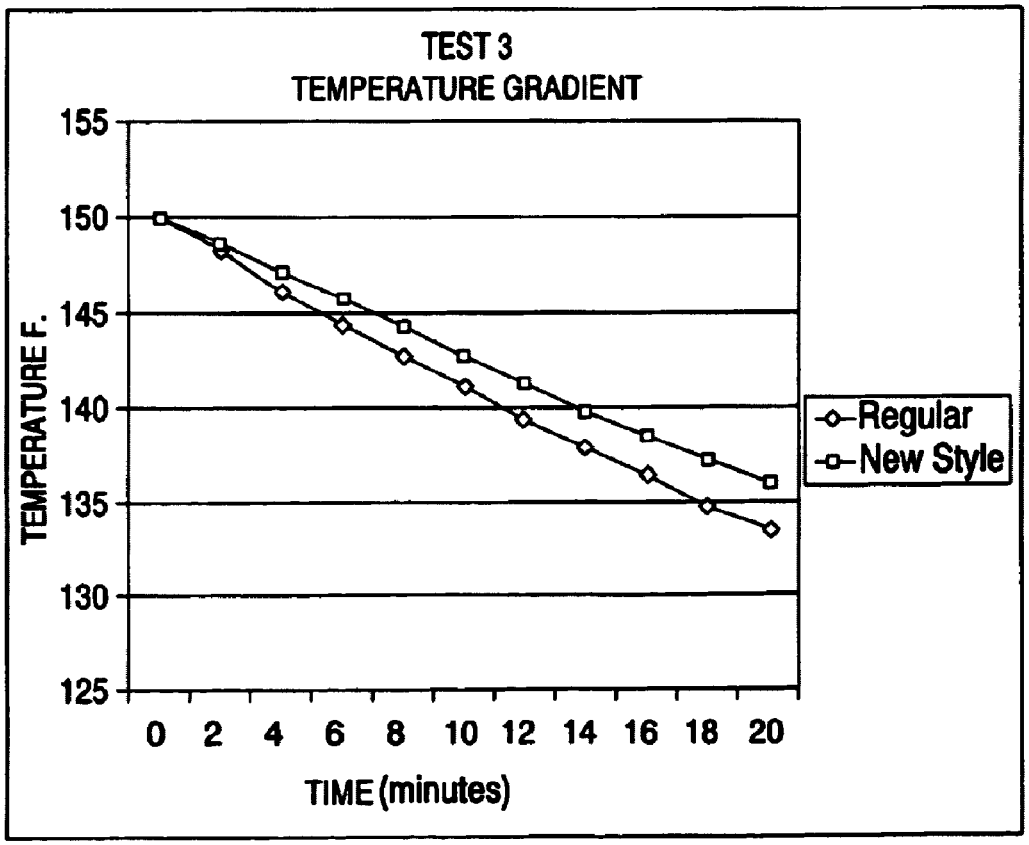
FIG. 22A discloses the test data for Test No. 3.
FIG. 22B discloses the Temperature Gradient graph for Test 3.

An unexpected advantage of the present invention concerns the temperature of the liquid in the channel during its use. Temperature gradient tests were conducted using the cup lid 10 of the preferred embodiment of the present invention which were compared to a conventional cup lid. The conventional cup lid comprised a common tear off section for drinking or pouring the liquid out of the cup. The test was conducted by pouring hot water at a temperature of 150 degrees Fahrenheit into two Styrofoam cups. One of the cups used the cup lid of the present invention and the other cup used a common cup lid which did not comprise the features of the present invention. The temperature of the contents of each cup were taken with a digital thermometer in degrees Fahrenheit by placing the temperature probe into each cup at a depth of approximately 1 inch below the surface of the water. The surrounding room temperature was 68 degrees Fahrenheit. Measurements were taken at 2-minute intervals with the water in each cup initially at 150 degrees Fahrenheit. Three sets of tests were conducted and the results are recorded in FIG. 20A and FIG. 20B; FIG. 21A and FIG. 21B; and FIG. 22A and FIG. 22B.

TEST NO. 1

| TIME minutes | CONVENTIONAL CUP LID Degrees Fahrenheit | PRESENT INVENTION CUP LID Degrees Fahrenheit |
|---|---|---|
| 0 | 150 | 150 |
| 2 | 148.3 | 148.5 |
| 4 | 146.2 | 147 |
| 6 | 144.3 | 145.3 |
| 8 | 142.9 | 143.9 |
| 10 | 140.9 | 142.3 |
| 12 | 139.1 | 141 |
| 14 | 137.7 | 139.5 |
| 16 | 136.2 | 138.4 |
| 18 | 134.8 | 137 |
| 20 | 133.5 | 135.7 |

TEST NO. 2

| TIME minutes | CONVENTIONAL CUP LID Degrees Fahrenheit | PRESENT INVENTION CUP LID Degrees Fahrenheit |
|---|---|---|
| 0 | 150 | 150 |
| 2 | 148.4 | 148.5 |
| 4 | 146.5 | 147 |
| 6 | 144.2 | 145.5 |
| 8 | 142.4 | 144.1 |
| 10 | 141.4 | 142.4 |
| 12 | 140 | 141.1 |
| 14 | 138.3 | 139.7 |
| 16 | 136.7 | 138.4 |
| 18 | 135.2 | 137.1 |
| 20 | 134 | 136 |

TEST NO. 3

| TIME minutes | CONVENTIONAL CUP LID Degrees Fahrenheit | PRESENT INVENTION CUP LID Degrees Fahrenheit |
|---|---|---|
| 0 | 150 | 150 |
| 2 | 148.2 | 148.6 |
| 4 | 146.1 | 147.1 |
| 6 | 144.3 | 145.7 |
| 8 | 142.7 | 144.2 |
| 10 | 141 | 142.7 |
| 12 | 139.3 | 141.2 |
| 14 | 137.8 | 139.7 |
| 16 | 136.4 | 138.4 |
| 18 | 134.7 | 137.1 |
| 20 | 133.4 | 135.9 |

Figure 23:
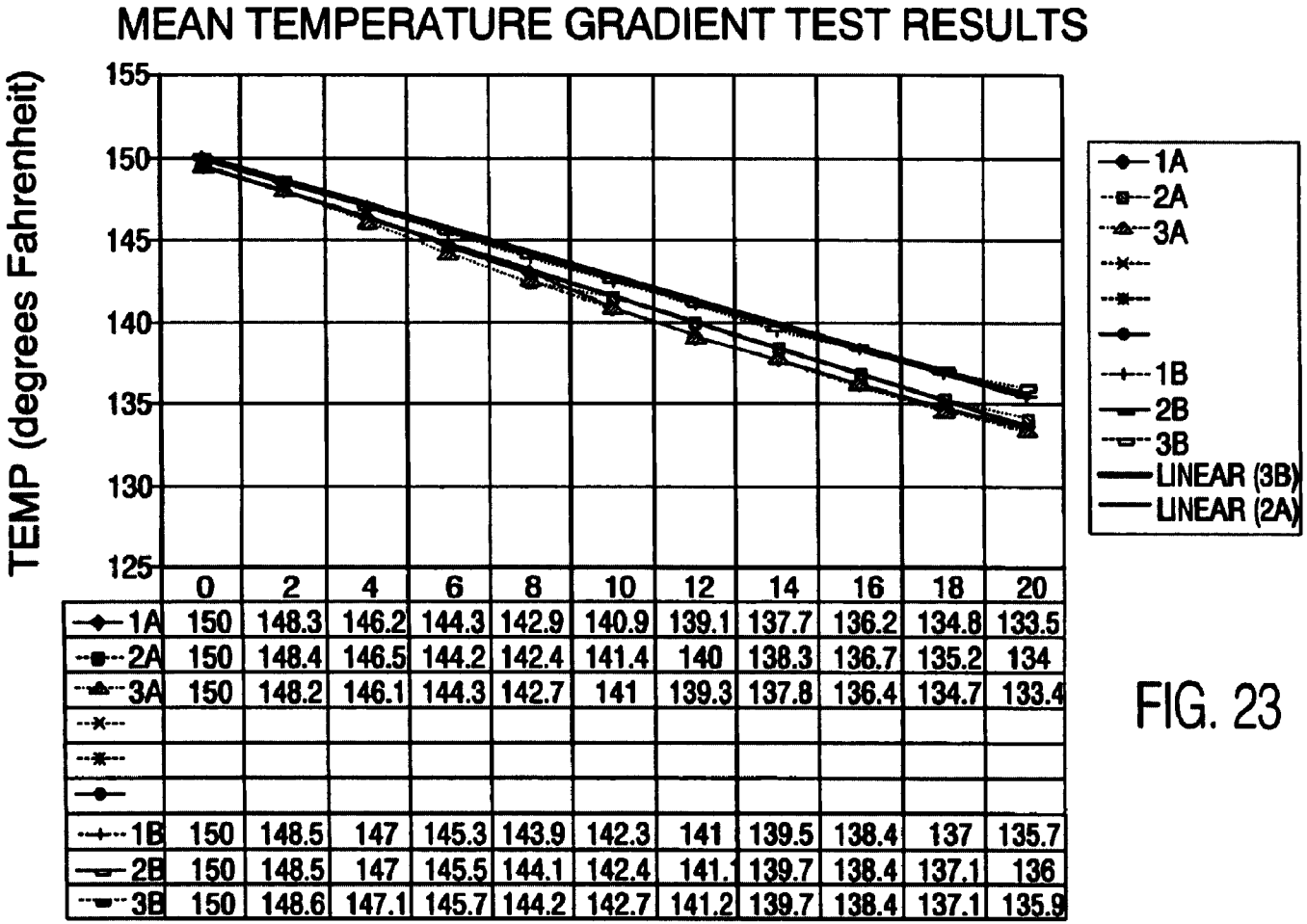
FIG. 23 discloses the Mean Temperature Gradient test data and graphs for Test 1, Test 2 and Test 3.

The graph shown in FIG. 23 discloses the median temperature gradient test results for all three tests combined.

As can be ascertained from the data from the tests, the average temperature of the hot water in the cup with the cup lid of the present invention at each 2-minute interval significantly hotter than the temperature of the water using the conventional cup lid. In other words, the hot liquid in the cups with a conventional cup lid cooled more quickly then the hot liquid in the cups with the cup lid of the present invention. Thus, in addition to the advantage of minimizing the spillage properties of a cup lid, another significant advantage of the present invention is that hot liquids will stay hotter for a longer time period. This feature is very desirous to consumers who want their hot drinks to stay hot for a longer period of time and to the restaurants and vendors of hot beverages who desire to satisfy their customer's needs.

Figure 10:
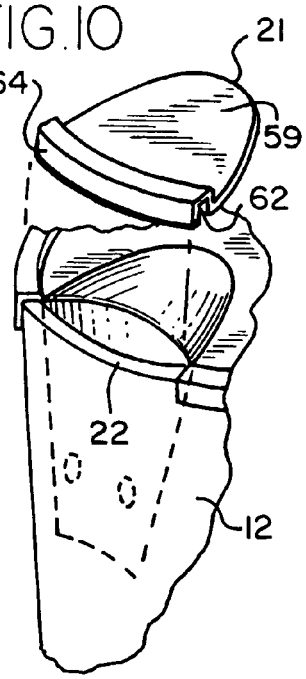
FIG. 10 is a perspective view of the preferred embodiment of the present invention showing the third part and a partial perspective view of drinking cup.

In a second embodiment of the present invention shown in FIG. 10, a third part 59 is shown which is hingedly attached to the top surface 40 of first part 24 along edge 31. Third part 59 is capable of moving from a closed position whereby slotted edge 62 located along the outer perimeter 64 of third part 59 and is releasably mounted to the rim 22 of cup 12 and an open position when slotted edge 62 is spaced apart and away from rim 22 of cup 12. Third part 59 is positioned substantially over and above first aperture 41 to form a substantially liquid tight seal 15 with rim 22 when in the closed position thereby preventing the egress of liquid 8 from the cup 12. Third part 59 may be easily removed from rim 22 by simply lifting it off the rim 22 and the contents of the cup may then be poured or drunk from the cup 12. Third part 59 may also be removed from cup lid 10 by tearing it off at hinge along edge 31.

Figure 11:
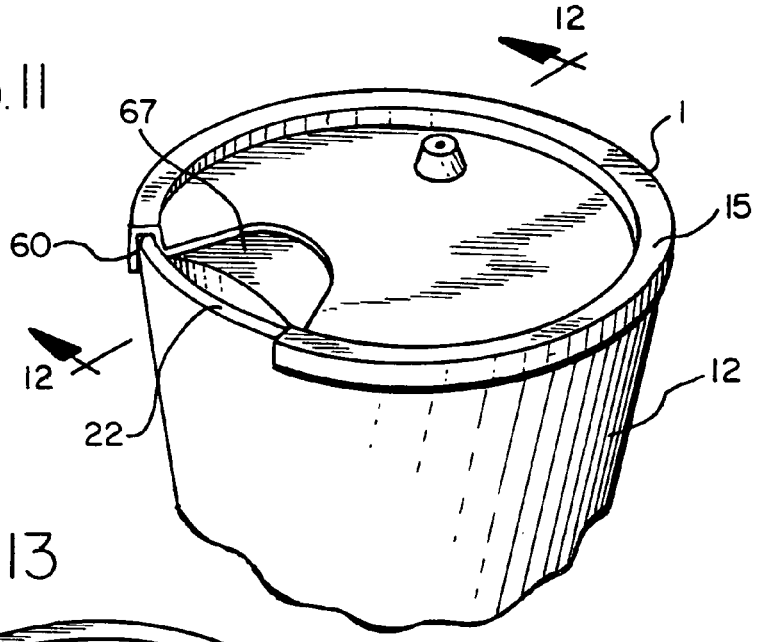
FIG. 11 is a perspective view of a second embodiment of the present invention and a partial perspective view of a drinking cup.
Figure 13:
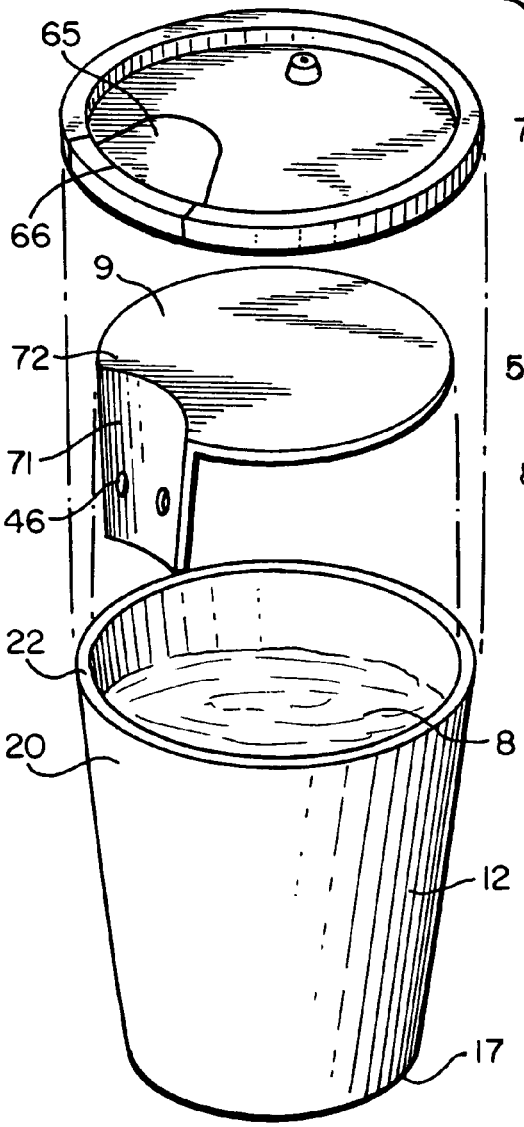
FIG. 13 is an exploded perspective view of the second embodiment of the present invention and a liquid filled drinking cup.
Figure 12:
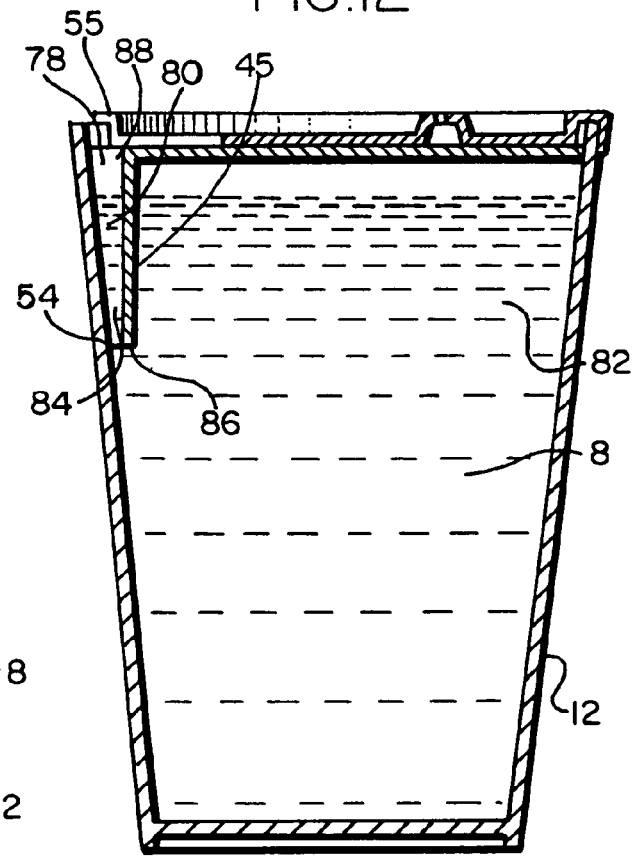
FIG. 12 is an end elevational cross-sectional view of the second embodiment of the present invention and a liquid filled drinking cup taken along line 12-12 of FIG. 11.
Figure 14:
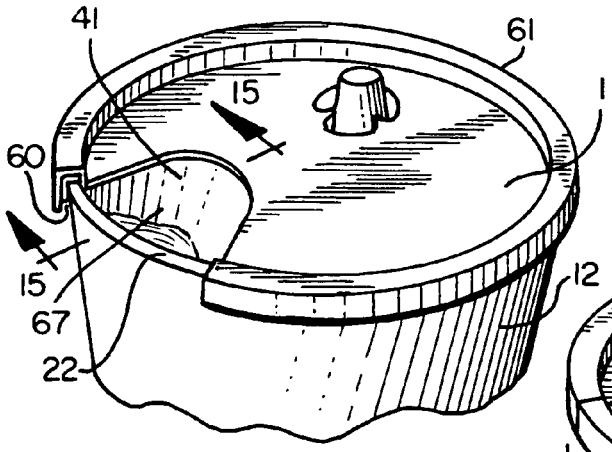
FIG. 14 is a perspective view of a third embodiment of the present invention and a partial perspective view of a drinking cup.
Figure 17:
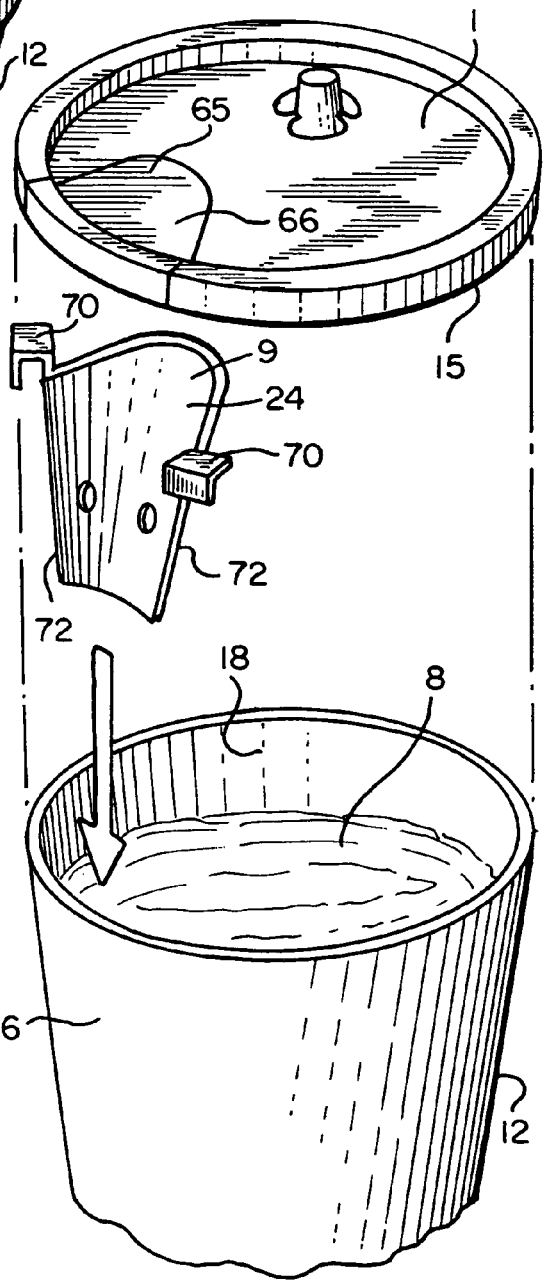
FIG. 17 is an exploded perspective view of the third embodiment of the present invention and a partial perspective view of the liquid filled drinking cup.
Figure 16:
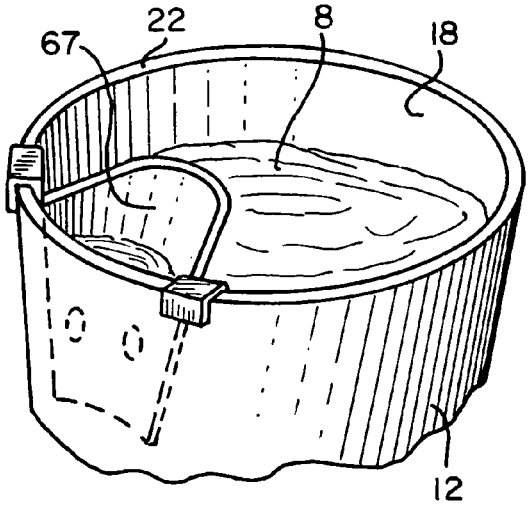
FIG. 16 is a perspective view of the third embodiment of the present invention and a partial perspective view of a liquid filled drinking cup.
Figure 15:
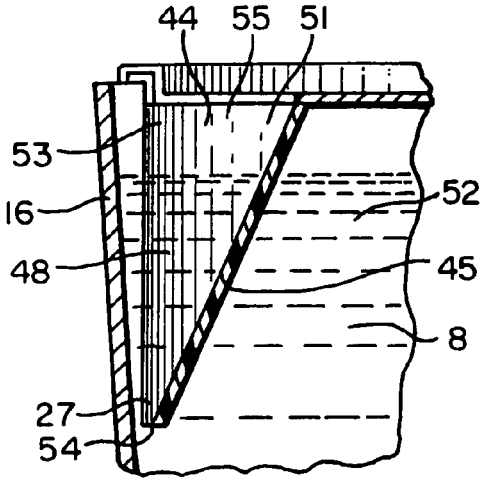
FIG. 15 is an elevational cross-sectional end view of the third embodiment of the present invention and a partial end elevational view of the liquid filled drinking cup taken along line 15-15 of FIG. 14.
Figure 18:
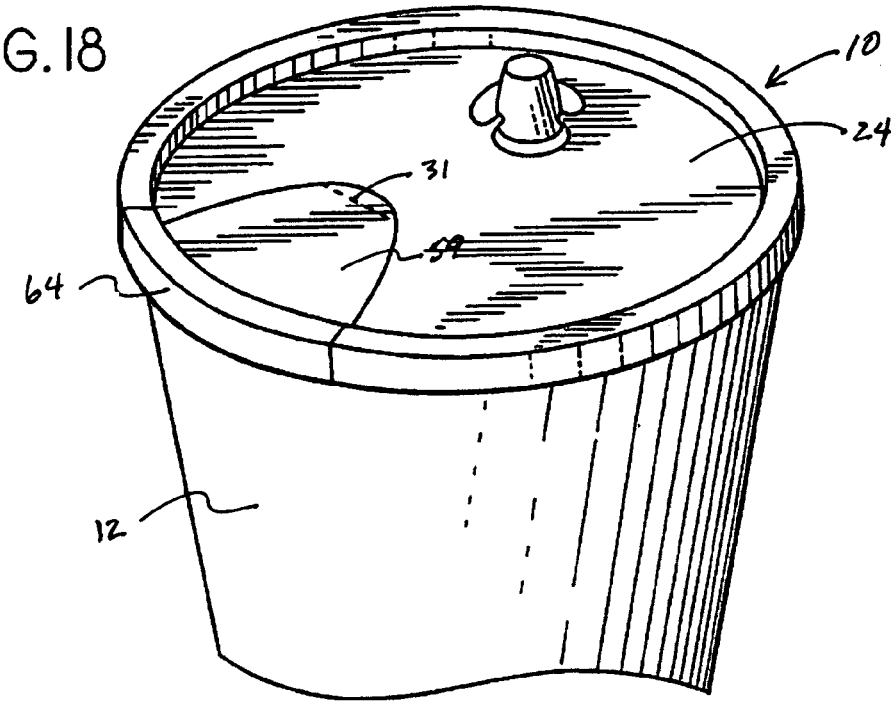
FIG. 18 is a perspective view of the preferred embodiment of the cup lid and drinking cup showing the third part in its closed position engaged with the rim of the drinking cup.
Figure 19:
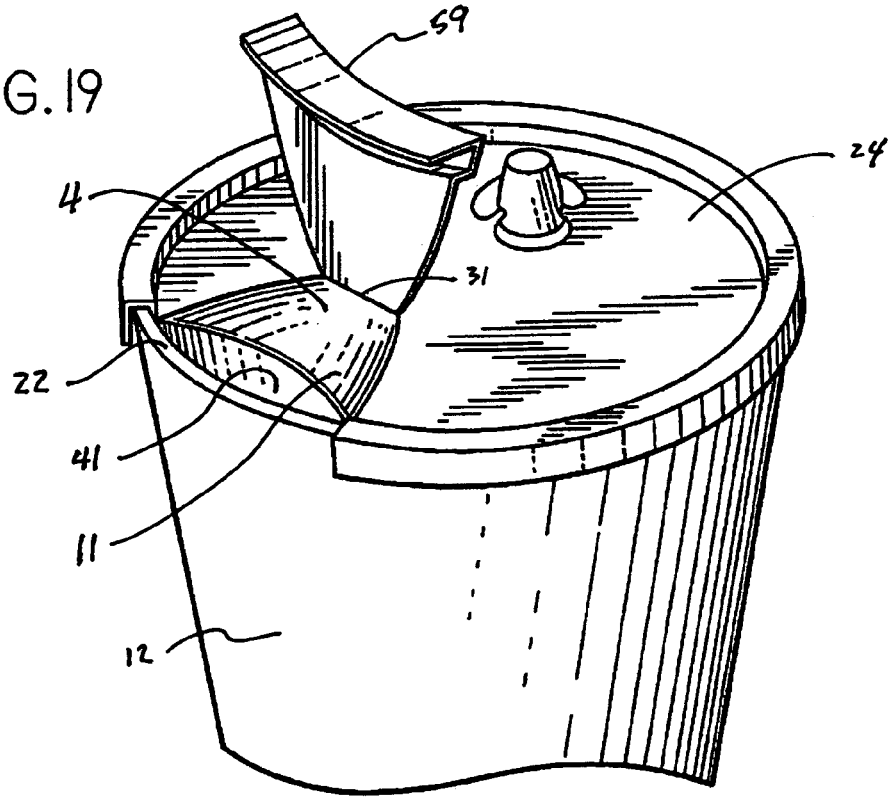
FIG. 19 is a perspective view of the preferred embodiment of the cup lid and drinking cup showing the third part in its open position disengaged with the rim of the drinking cup.

A third embodiment of the present invention is shown in FIG. 11 to FIG. 13. The third embodiment of the present invention comprises an insert 9 that is used in combination with conventional cup lid 1. Cup lid 1 comprises a slotted peripheral edge 60 which extends around the perimeter 61 of cup lid 1 and which is releasably mounted to rim 22 in the same manner as the cup lid 10 of the preferred embodiment of the present invention is releasably mounted to the cup rim 22. Lid 1 further comprises a third part 65 which is hingedly attached to the cup lid 1 for movement between a closed position 66 for releasable mounting to the rim 22 of cup 12 to form a liquid tight seal 15 with the slotted edge 60 of lid 1 to cup 12 (FIG. 13) and an open position (not shown) wherein third part 65 is released from its mounted position on rim 22 of cup 12 and may be either left alone to hang on cup lid 1 as a "chad" or may be entirely removed, as shown in FIG. 11 leaving aperture 67.

The insert 9 of the third embodiment of the present invention shown in FIG. 13 comprises a flat circular first part 72 lying in a plane which comprises means for releasably mounting the first part 72 to the top or upper end 20 of cup 12 so that first part 72 lies parallel to the base 17 of cup 12 when it is inserted into cup 12. The diameter of first part 72 is of the same size as the diameter of the top or upper end 20 of cup 12 measured from the inner sidewall surface 18 of cup 12. Cup 12 comprises an inner sidewall surface diameter which is tapered and consequently decreases in size downwardly towards base 17. This change in size will insure a snug fit of first part 72 into the top or upper end 20 of cup 12 slightly below the rim 22 of cup 12. Insert 72 further comprises a second part 74 which depends from first part 72 in a downward non-coplanar direction and which is rigidly attached to first part 72. Second part 74 is concave in cross sectional shape 76 and is formed at an angle relative to first part 72 which causes second part 74 to conform to the tapered angle of the sidewall inner surface 18 of cup 12. The purpose of this construction is for second part 74 to rest continuously against the inner sidewall surface 18 of cup 12 when insert 72 is mounted into the cup 12 to form a compartment 78 for separating the liquid contained therein from the liquid in the rest of the cup 12 into two portions, one portion 80 and a second portion 82. Compartment 78 comprises a channel 84 which allowed the liquid in the cup to enter the compartment 78 and exit the cup 12 through aperture 67. Second part 74 further comprises at least a third aperture 46 which facilitates the flow of liquid into and out of the channel 84. Channel 84 comprises a lower end 86 and an upper end 88. Lower end 86 forms second aperture 55 for ingress of the liquid into channel 84. Upper end 88 forms third second aperture 55 for egress of the liquid out of the channel 84. Second part 74 acts as a baffle 45 which substantially isolates the liquid 8 in the channel 84 from wave interference with the movement of the liquid 8 which is outside the channel 84 in second portion 82. This feature will preclude most of the spillage of the liquid 8 out of the cup 12 especially during lateral movement of the cup 12. Insert 9 will not function properly without the use of cup lid 1 since insert 9 is not securely mounted within the top or upper end 20 of cup 12 but is only held in place by the force fit between the edge 90 of first part 72 and the inner sidewall surface 18 of cup 12. Further, third part 65 must be substantially aligned above channel 55 in order for liquid 8 to efficiently flow out of first aperture 41.

A fourth embodiment of the present invention is shown in FIG. 14 to FIG. 17. The fourth embodiment of the present invention comprises an insert 9 that is used in combination with cup lid 1. Cup lid 1 comprises a slotted peripheral edge 60 which extends around the perimeter 61 of cup lid 1 and which is releasably mounted to rim 22 in the same manner as the cup lid 10 of the preferred embodiment of the present invention is releasably mounted to the cup rim 22. Lid 1 further comprises a third part 65 which is hingedly attached to the cup lid 1 for movement between a closed position 66 (FIG. 17) for releasable mounting to the rim 22 of cup 12 to form a liquid tight seal 15 with the slotted edge 60 of lid 1 and an open position (not shown) wherein third part 65 is released from its mounted position on rim 22 but is left attached as a "chad" to lid 1. In the alternative, third part 65 may be permanently removed from lid 1 by tearing it off lid 1. See, FIG. 14) Substantially below and aligned with third part 65, insert 9 is attached to rim 22 with attachment means or hooks 70 thereby creating a first aperture 41 for drinking or pouring the liquid contents out of cup 12. The insert 9 comprises a first part 24 having a concave surface 68 and two hook like members 70 or attachment means which releasably mount the insert 9 to the rim 22 of cup 12. The angel of first part 24 relative to the tapered angle of sidewall surface 16 of cup 12 is such that when insert 9 is placed over rim 22, the two end surfaces 72 of insert 9 come to rest adjacent the inner sidewall surface 18 of cup 12 to form a compartment means 49 for separating the liquid 8 into two portions: one portion 51 of liquid 8 is contained within compartment 49, while the second portion 52 of liquid 8 is contained in the rest of cup 12. Compartment 49 comprises a channel 48 which allows the liquid in the cup 12 to ingress the compartment 49 through second aperture 27 at the bottom end 27 of channel 48 and to egress out of the cup 12 through third aperture 55 at upper end 53 of channel 48. Insert 9 acts as a baffle 45 which substantially isolates wave movement of the liquid 8 in the channel 48 from any interference with the wave movement of the liquid 8 which is in second portion 52 of cup 12. This feature substantially precludes spillage of most of the liquid 8 out of the cup 12 especially during moderate to fast lateral movement of the cup 12. Insert 9 cannot be securely attached to rim 22 without the use of cup lid 1 since insert 9 will not be securely mounted to rim 22 unless lid 1 is also mounted onto rim 22.

Other embodiments and variations of the cup lid in keeping with the present invention may be realized, without departing from the sprit and scope of the appended claims.

What is claimed is:

1. A cup lid in combination with a drinking cup containing a liquid, said drinking cup having a base and a sidewall extending upwardly from the base, the sidewall including an inner surface, a top end, and a rim extending along the circumference of the top end, the cup lid comprising:

a first part lying in a first plane and having a top surface and a center axis;

means on said first part for releasably mounting said first part to the top end of the cup to form a substantially liquid tight seal between the cup lid and the cup;

a second part depending radially outwardly from said first part and lying in a second plane;

compartment means formed by said second part and said inner sidewall surface for bifurcating a portion of the liquid in the cup into one portion and a second portion;

said one portion comprising means for facilitating the flow of liquid into said compartment means and said second portion for facilitating the flow of liquid out of said compartment means;

said first part and said second part further comprise aperture means for permitting the liquid contained in said one portion to flow out of said compartment means and out of the drinking cup;

said second part comprises baffle means for substantially shielding the liquid in said one portion from substantial interference with the liquid in said second portion during any lateral movement of the cup thereby any spillage of the liquid out of the cup is substantially minimized;

means on said second part for the downward movement of said second part from a first position wherein said second part is substantially co-planar to said first part, to a second position wherein said second part is non-coplanar with said first part;

said one portion comprising means for permitting the ingress of liquid from said second portion into said one portion when said second part is in said second position for permitting the egress of the liquid out of said one portion;

a first aperture at said bottom end when said second part is at said second position to permit the liquid to ingress into said channel; and, a second aperture at said upper end when said second part is at said second position to permit the liquid to egress out of said channel.

2. The cup lid of claim 1 wherein said first part and said second part further comprise biasing means for urging at least a portion of said second part to move adjacent said inner sidewall surface when said cup lid is releasably mounted to the top end of the cup.

3. The cup lid of claim 1 and further comprising at least one aperture on said second part for facilitating the flow of the liquid contained in said second portion into said compartment means.

4. The cup lid of claim 1 wherein:

said first part comprising a first section and a second section;

said second section having a substantially flat cross-sectional area;

said first section comprising a substantially concave cross-sectional area relative to said second section when said second part is in said first position; and, said second part comprises a substantially concave cross-sectional area relative to said second section when said second part is in said first position.

5. The cup lid in claim 4 wherein:

said second part comprises a concave cross-sectional area relative to said second section of said first part when said second part is in said second position; and, said first section of said first part comprises a convex cross-sectional area relative to said second section of said first part when said second part is in said second position.

6. The cup lid of claim 1 wherein said second part comprises a longitudinal flange.

7. The cup lid of claim 6 wherein said longitudinal flange is tapered in a direction away from said first part.

8. The cup lid of claim 1 wherein:

said first part further comprises a slotted peripheral edge extending at least along the perimeter of said first part; and, said slotted edge comprises means for releasably mounting the cup lid to the rim for forming a substantially liquid tight seal between the cup lid and the cup.

9. The cup lid of claim 4 wherein said second part comprises:

a proximal end which is integral with and hingedly attached to said first part; and, a distal end which is spaced apart and away from said proximal end.

10. The cup lid of claim 9 wherein:

said first section comprises the shape of a parabola;

said parabola comprises an apex and a base;

said apex is spaced apart and away from said base; and, said base is proximate to said proximal end of said second part and said apex is proximate to said center axis.

11. The cup lid of claim 10 wherein:

said base comprises the shape of an arc; and, said arc comprises an apex and an axis of rotation wherein said arc is facing concave in the direction of said distal end of said second part and is facing convex in the direction of said center axis of said first part.

12. The cup lid of claim 11 wherein:

said base of said arc further comprises a crease in said cup lid; and, said crease coincides with the length and direction of said arc.

13. The cup lid of claim 12 wherein said apex of said arc rotates in an upward direction about the axis of rotation of said arc when said second part is moved from its first position to its second position thereby creating biasing means in said first part and in said second part for causing said second part to move substantially adjacent to said inner sidewall surface when said cup lid is releasably mounted to the cup.

14. The cup lid of claim 9 wherein said second aperture is located between the rim and the proximal end of said second part when said second part is at its second position.

15. The cup lid of claim 14 wherein said first aperture is located between the inner sidewall surface and said distal end of said second part when said second part is at its second position.

16. The cup lid of claim 1 and further comprising:

a third part hingedly attached to said first part; and, means on said third part for movement between a closed position wherein said third part is releasably mounted to the cup and is positioned substantially over and above said aperture means to form a substantially liquid tight seal between the cup lid and the cup thereby preventing the substantial egress of liquid out of the cup and an open position wherein said third part is released from the cup thereby permitting the egress of liquid out of the cup through said aperture means.

17. The cup lid of claim 16 wherein said third part further comprises means for removing said third part from said first part.

18. A cup lid in combination with a drinking cup, containing a liquid, the drinking cup having a base and a sidewall extending upwardly from the base, the sidewall including an inner surface, a top end, and a rim extending along the circumference of the top end, the cup lid comprising:

a first part having a substantially flat circular surface area and lying in a first plane;

said first part further comprising a perimeter and a center axis;

a slotted edge downwardly depending from said first part along said perimeter of said first part;

said slotted edge having means for releasable attachment to the rim of the cup to form a substantially liquid tight seal between the cup lid and the cup;

a second part which is integral with and hingedly attached to said first part and which depends outwardly and radially away from said first part in said first plane;

said second part having a proximal end which is located adjacent to said first part and a distal end which is spaced apart and away from said proximal end;

said second part further comprises a concave cross sectional area relative to said first plane;

said second part having means for movement relative to said first part from a first position which is co-planar with said first part to a second position which is non-coplanar with said first part;

said first part and said second part comprise biasing means for urging said second part to move substantially adjacent to said inner sidewall surface of the cup;

compartment means formed by said second part and said inner sidewall surface for bifurcating the liquid in the cup into one portion and a second portion;

said one portion having means for allowing the liquid in the cup to flow into said compartment means and for allowing the liquid in the cup to flow out of said compartment means;

aperture means on said first part and on said second part for allowing the liquid in the cup to flow out of the cup;

said compartment means comprises an upper end and a bottom end;

said bottom end comprises means for forming a first aperture to permit liquid in the cup to ingress into said compartment means;

said upper end comprise means for forming a second aperture to permit liquid in the cup to egress out of said compartment means and said aperture means; and, said second part further comprises baffle means for substantially isolating the liquid in said one portion from substantial wave interference with the wave movement of the liquid in said second portion to preclude substantial spillage of the liquid out of the cup during any lateral movement of the cup when said cup lid is mounted to the cup.

19. A cup lid for use with a cup having a top edge, said cup lid comprising:

a first part lying in a first plane and having a top surface, said first part further comprising a center axis perpendicular to said first plane and an edge having a perimeter;

means on said first part for releasably mounting said first part to the top edge of the cup to provide a substantially liquid tight seal between the cup and said first part;

a second part extending outwardly from said first part, lying in a second plane and having a longitudinal axis;

means on said first part and on said second part for the downward movement of said second part between:

a first position wherein said second plane is co-planar with said first plane;

a second position which is spaced apart and away from said first position wherein said second plane is not co-planar with said first plane; and, a third position spaced between said first position and said second position wherein said second plane is not co-planar with said first plane;

said first part and said second part further comprising biasing means for the movement of said second part away from said second position and towards said third position;

means on said first part and on said second part for forming an opening which is contiguous to said perimeter and is created when said second part is moved from its first position to its second or third positions;

said first part further comprises a first section and a second section;

said second section is substantially flat and lies in said first plane;

said first section further comprises a concave cross-sectional area when said second part is in said first position; and, said second part further comprises a concave cross-sectional area when said second part is in said first position.

said second part further comprises a concave cross-sectional area when said second part is in said second position; and, said first section of said first part comprises a convex cross-sectional area when said second part is moved from its first position.

20. The cup lid of claim 19 wherein said second part comprises a longitudinal flange having a proximal end and a distal end.

21. The cup lid of claim 20 wherein said flange is tapered away from said proximal end and to said distal end.

22. The cup lid of claim 20 wherein said longitudinal flange further comprises at least one opening.

23. The cup lid of claim 20 and further comprising:

said proximal end of said second part is integral with and moveable relative to said first part; and, said distal end is spaced apart and away from said proximal end.

24. The cup lid of claim 23 wherein:

said first section comprises the shape of a parabola;

said parabola comprises an apex and a base and lies in said second plane;

said apex is spaced apart and away from said base;

said base is located near to said proximal end of said second part; and, said apex is located between said base and said center axis.

25. The cup lid of claim 24 wherein:

said base comprises an arc; and, said arc comprises an apex having an axis of rotation.

26. The cup lid of claim 25 wherein:

said arc further comprises a crease on said first part; and, said crease comprises means for creating said biasing means on said first part and said second part and for facilitating the movement of said second part relative to said first part.

27. The cup lid of claim 26 and further comprising means on said arc apex for movement in an upward direction relative to said second plane about said arc axis of rotation when said second part is moved from its first position towards its second position thereby creating biasing means in said first section to force the movement of said second part away from said second position and towards said third position.

28. The cup lid of claim 19 and further comprising:

a third part having a substantially flat surface, an outer edge and lying in a third plane; and, means for mounting said third part to said first part for movement of said third part between a closed position wherein said outer edge is engaged with the top edge of the cup to provide a substantially liquid tight seal therewith when said second part is moved from its first position and an open position wherein said outer edge is disengaged from said top edge of the cup thereby exposing said opening which is created by the movement of said first part and said second part away from its first position.

29. The cup lid of claim 28 wherein said third part and said first part further comprise means for removing said third part from said first part.

* * * * *